US007207712B2

(12) United States Patent
Kozyuk

(10) Patent No.: US 7,207,712 B2
(45) Date of Patent: Apr. 24, 2007

(54) DEVICE AND METHOD FOR CREATING HYDRODYNAMIC CAVITATION IN FLUIDS

(75) Inventor: Oleg V. Kozyuk, Westlake, OH (US)

(73) Assignee: Five Star Technologies, Inc., Cleveland, OH (US)

( * ) Notice: Subject to any disclaimer, the term of this patent is extended or adjusted under 35 U.S.C. 154(b) by 193 days.

(21) Appl. No.: 10/935,206

(22) Filed: Sep. 7, 2004

(65) Prior Publication Data

US 2006/0050608 A1 Mar. 9, 2006

(51) Int. Cl.
*B01F 5/06* (2006.01)

(52) U.S. Cl. ..... 366/341; 138/40; 138/46

(58) Field of Classification Search ..... 366/176.1, 366/176.2, 336–338, 340, 341; 138/37, 40, 138/42, 43, 46

See application file for complete search history.

(56) References Cited

U.S. PATENT DOCUMENTS 5,492,654 A 2/1996 Kozjuk et al.
5,810,052 A 9/1998 Kozyuk
5,810,474 A * 9/1998 Hidalgo ..... 366/171.1
5,937,906 A 8/1999 Kozyuk
5,969,207 A 10/1999 Kozyuk
5,971,601 A 10/1999 Kozyuk
6,012,492 A 1/2000 Kozyuk
6,035,897 A 3/2000 Kozyuk
6,502,979 B1 1/2003 Kozyuk
2003/0147303 A1 * 8/2003 Schueler ..... 366/176.2
2004/0042336 A1 * 3/2004 Kozyuk ..... 366/167.1
2004/0071044 A1 4/2004 Kozyuk

* cited by examiner

*Primary Examiner*—David Sorkin
(74) *Attorney, Agent, or Firm*—Benesch, Friedlander, Coplan & Aronoff LLP

(57) ABSTRACT

A device and method for creating hydrodynamic cavitation in fluid is provided. The device can include a flow-through chamber having a first portion and a second portion, and a plurality of baffles provided within the second portion of the flow-through chamber. One or more of the plurality of baffles can be configured to be selectively movable into the first portion of the flow-through chamber to generate a hydrodynamic cavitation field downstream from each baffle moved into the first portion of the flow-through chamber.

18 Claims, 5 Drawing Sheets

DEVICE AND METHOD FOR CREATING HYDRODYNAMIC CAVITATION IN FLUIDS

BACKGROUND OF THE INVENTION

One of the most promising courses for further technological development in chemical, pharmaceutical, cosmetic, refining, food products, and many other areas relates to the production of emulsions and dispersions having the smallest possible particle sizes with the maximum size uniformity. Moreover, during the creation of new products and formulations, the challenge often involves the production of two, three, or more complex components in disperse systems containing particle sizes at the submicron level. Given the ever-increasing requirements placed on the quality of dispersing, traditional methods of dispersion that have been used for decades in technological processes have reached their limits. Attempts to overcome these limits using these traditional technologies are often not effective, and at times not possible.

Hydrodynamic cavitation is widely known as a method used to obtain free disperse systems, particularly lyosols, diluted suspensions, and emulsions. Such free disperse systems are fluidic systems wherein dispersed phase particles have no contacts, participate in random beat motion, and freely move by gravity. Such dispersion and emulsification effects are accomplished within the fluid flow due to cavitation effects produced by a change in geometry of the fluid flow.

Hydrodynamic cavitation is the formation of cavities and cavitation bubbles filled with a vapor-gas mixture inside the fluid flow or at the boundary of the baffle body resulting from a local pressure drop in the fluid. If during the process of movement of the fluid the pressure at some point decreases to a magnitude under which the fluid reaches a boiling point for this pressure, then a great number of vapor-filled cavities and bubbles are formed. Insofar as the vapor-filled bubbles and cavities move together with the fluid flow, these bubbles and cavities may move into an elevated pressure zone. Where these bubbles and cavities enter a zone having increased pressure, vapor condensation takes place withing the cavities and bubbles, almost instantaneously, causing the cavities and bubbles to collapse, creating very large pressure impulses. The magnitude of the pressure impulses within the collapsing cavities and bubbles may reach 150,000 psi. The result of these high-pressure implosions is the formation of shock waves that emanate from the point of each collapsed bubble. Such high-impact loads result in the breakup of any medium found near the collapsing bubbles.

A dispersion process takes place when, during cavitation, the collapse of a cavitation bubble near the boundary of the phase separation of a solid particle suspended in a liquid results in the breakup of the suspension particle. An emulsification and homogenization process takes place when, during cavitation, the collapse of a cavitation bubble near the boundary of the phase separation of a liquid suspended or mixed with another liquid results in the breakup of drops of the disperse phase. Thus, the use of kinetic energy from collapsing cavitation bubbles and cavities, produced by hydrodynamic means, can be used for various mixing, emulsifying, homogenizing, and dispersing processes.

BRIEF DESCRIPTION OF THE DRAWINGS

It will be appreciated that the illustrated boundaries of elements (e.g., boxes or groups of boxes) in the figures represent one example of the boundaries. One of ordinary skill in the art will appreciate that one element may be designed as multiple elements or that multiple elements may be designed as one element. An element shown as an internal component of another element may be implemented as an external component and vice versa.

Further, in the accompanying drawings and description that follow, like parts are indicated throughout the drawings and description with the same reference numerals, respectively. The figures are not drawn to scale and the proportions of certain parts have been exaggerated for convenience of illustration.

DETAILED DESCRIPTION OF ILLUSTRATED EMBODIMENTS

Figure 1:
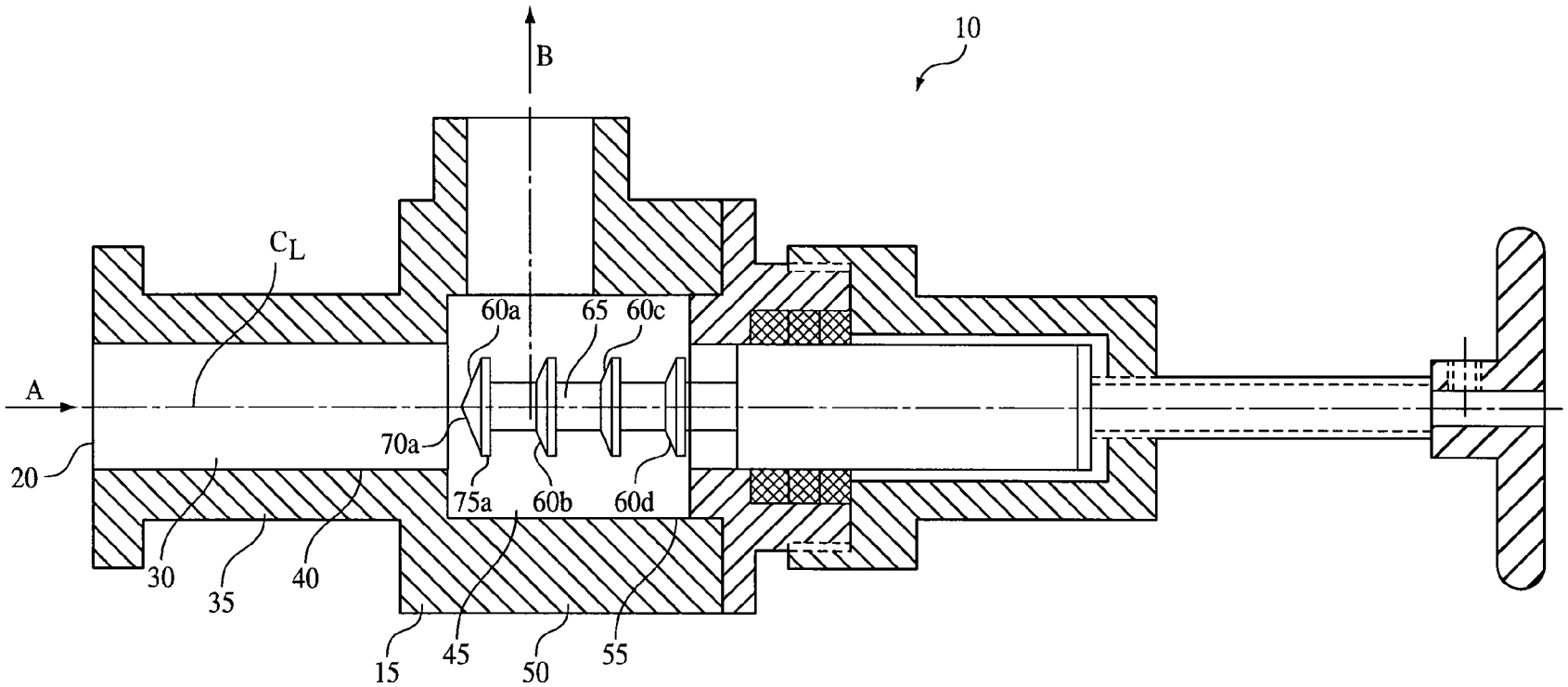
FIG. 1 illustrates a longitudinal cross-section of one embodiment of a device 10 that can be dynamically configured to generate one or more stages of hydrodynamic cavitation in a fluid.

Illustrated in FIG. 1 is a longitudinal cross-section of one embodiment of a device 10 that can be dynamically configured to generate one or more stages of hydrodynamic cavitation in a fluid.

In one embodiment, the device 10 can include a flow-through channel or chamber 15 having a centerline $C_L$. The device 10 can also include an inlet 20 configured to introduce a fluid into the device 10 along a path represented by arrow A and an outlet 25 configured to permit the fluid to exit the device 10 along a path represented by arrow B.

In one embodiment, the flow-through chamber 15 can include an upstream portion 30 that is defined by a wall 35 having an inner surface 40 and a downstream portion 45 that is defined by a wall 50 having an inner surface 55. The upstream portion 30 of the flow-through chamber 15 can have, for example, a circular cross-section. Similarly, the downstream portion 45 of the flow-through chamber 15 can have a circular cross-section. Obviously, it will be appreciated that the cross-sections of the upstream and downstream portions 30, 45 of the flow-through chamber 15 can take the form of other geometric shapes, including without limitation square, rectangular, hexagonal, octagonal or any other shape. Moreover, it will be appreciated that the cross-sections of the upstream and downstream portions 30, 45 of the flow-through chamber 15 can be different from each other or the same.

In one embodiment, the diameter or major dimension of the upstream portion 30 of the flow-through chamber 15 is less than the diameter or major dimension of the downstream portion 45 of the flow-through chamber 15. The differences in diameter or major dimension between the upstream portion 30 of the flow-through chamber 15 and the downstream portion 45 of the flow-through chamber 15 can assist in the process of selectively generating one or more cavitation stages in the fluid. For example, the fluid can be subjected to one or more hydrodynamic cavitation stages in the upstream portion 30 of the flow-through chamber 15, but not in the downstream portion 45 of the flow-through chamber 15, which will be discussed in further detail below.

With further reference to FIG. 1, the device 10 can include a plurality of cavitation generators. The cavitation generators can be configured to generate a hydrodynamic cavitation field downstream from each cavitation generator when a selected generator is moved into and positioned within the upstream portion 30 of the flow-through chamber 15, which will be discussed in further detail below. In one embodiment, the plurality of cavitation generators can include, for example, a first baffle 60*a*, a second baffle 60*b*, a third baffle 60*c*, and a fourth baffle 60*d* connected in series along the length of a shaft 65. For example, the baffles 60*a–d* can be attached in a fixed position relative to one another along the shaft 65 and can be positioned substantially along the centerline $C_L$ of the flow-through chamber 15 such that each baffle is substantially coaxial with the other baffles. It will be appreciated that other types of cavitation generators may be used instead of baffles. Furthermore, it will be appreciated that any number of baffles or other cavitation generators can be used to implement the device 10.

In one embodiment, the baffles 60*a–d* can be disposed in the flow-through chamber 15. For example, all of the baffles 60*a–d* can be initially disposed in the downstream portion of the flow-through chamber 15 as shown in FIG. 1. Alternatively, one or more of the baffles (e.g., first baffle 60*a*) can be initially disposed in the upstream portion 30 of the flow-through channel 15, while the remaining baffles (e.g., second, third, and fourth baffles 60*b–d*) can be initially disposed in the downstream portion 45 of the flow-through channel 15.

To vary the degree and character of the cavitation fields generated downstream from each baffle, the baffles 60*a–d* can be embodied in a variety of different shapes and configurations. For example, the baffles 60*a–d* can be conically shaped where the baffles 60*a–d* each include a conically-shaped surface 70*a–d*, respectively, that extends to a cylindrically-shaped surface 75*a–d*, respectively. The baffles 60*a–d* can be oriented such that the conically-shaped portions 70*a–d*, respectively, confront the fluid flow. It will be appreciated that the baffles 60*a–d* can be embodied in other shapes and configurations such as the ones disclosed in FIGS. 3*a–*3*f* of U.S. Pat. No. 6,035,897, which is hereby incorporated by reference in its entirety herein. Of course, it will be appreciated that each baffle can differ in shape and configuration from each other or the baffles 60*a–d* can have the same shape and configuration.

As discussed above, each baffle 60*a–d* is configured to generate a hydrodynamic cavitation field downstream therefrom when a baffle is selectively moved into the upstream portion 30 of the flow-through chamber 15. Accordingly, when one or more baffles 60*a–d* are moved into the upstream portion 30 of the flow-through chamber 15, the fluid passing through the device 10 can be subjected to a selected number of cavitation stages depending on the number of baffles moved into the upstream portion 30 of the flow-through chamber 15. In general, the number of baffles moved into the upstream portion 30 of the flow-through chamber 15 corresponds to the number of cavitation stages that the fluid is subjected to. In this manner, the device 10 can be dynamically configurable in multiple states in order to subject the fluid to a selected number of cavitation stages.

Figure 2:
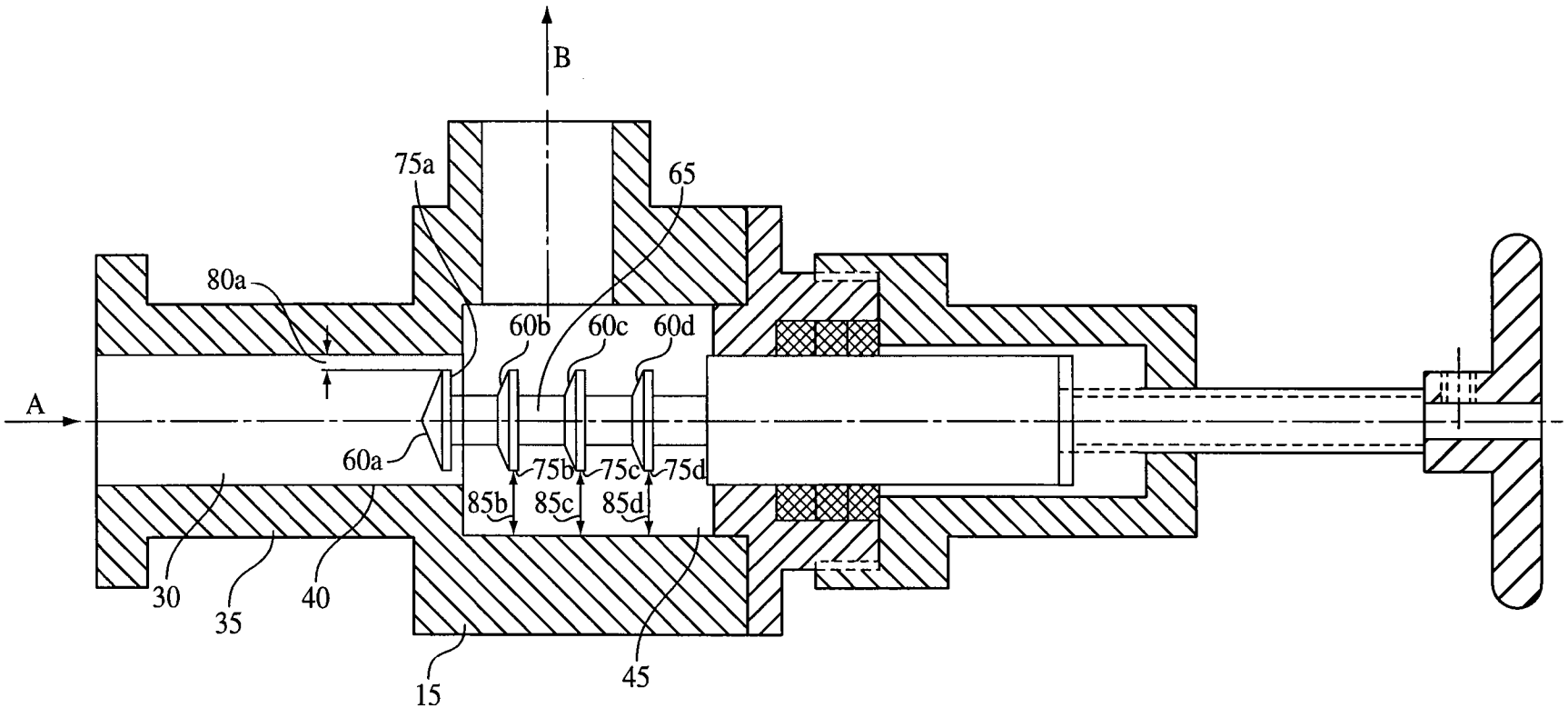
FIG. 2 illustrates the device 10 configured in a first state in order to subject the fluid to a single stage of hydrodynamic cavitation.

Illustrated in FIG. 2 is one embodiment of the device 10 configured in a first state in order to subject the fluid to a single stage of hydrodynamic cavitation. In this first state, the first baffle 60*a* is positioned in the upstream portion 30 of the flow-through chamber 15, while the remaining baffles (i.e., baffles 60*b–d*) are positioned in the downstream portion 45 of the flow-through chamber 15. When the first baffle 60*a* is positioned in the upstream portion 30 of the flow-through chamber 15, the first baffle 60*a* is configured to generate a first hydrodynamic cavitation field downstream from the first baffle 60*a* via a first local constriction 80*a* of fluid flow. The first local constriction 80*a* of fluid flow can be, for example, a gap defined between the inner surface 40 of the upstream wall 35 and the cylindrically-shaped surface 75*a* of the first baffle 60*a*.

In one embodiment, the size of the local constriction 80*a* is sufficient enough to increase the velocity of the fluid flow to a minimum velocity necessary to achieve hydrodynamic cavitation, the minimum velocity being dictated by the physical properties of the fluid being processed. For example, the size of the local constriction 80*a*, or any local constriction of fluid flow discussed herein, can be set in such a manner so that the cross-section area of the local constriction 80*a* would be at most about 0.6 times the diameter or major diameter of the cross-section of the flow-through chamber 15. On average, and for most hydrodynamic fluids, the minimum velocity can be about 16 m/sec (52.5 ft/sec) and greater.

In this first state, the fluid is subjected to a single stage of cavitation because the first baffle 60*a* is the only baffle positioned in the upstream portion 30 of the flow-through chamber 15. The remaining baffles (i.e., second, third, and fourth baffles 60*b–d*) are positioned in the downstream portion 45 of the flow-through chamber 15, which provides gaps 85*b–d* defined between the inner surface 55 of the downstream wall 50 and the cylindrically-shaped surfaces 75*b–d* of the baffles 60*b–d*, respectively. The size of gaps 85*b–d* are sufficiently large enough so as to not materially affect the flow of the fluid. In other words, the gaps 85*b–d* are sufficiently large enough so that hydrodynamic cavitation is not generated downstream from each baffle positioned in the downstream portion 45 of the flow-through chamber 15.

Figure 3:
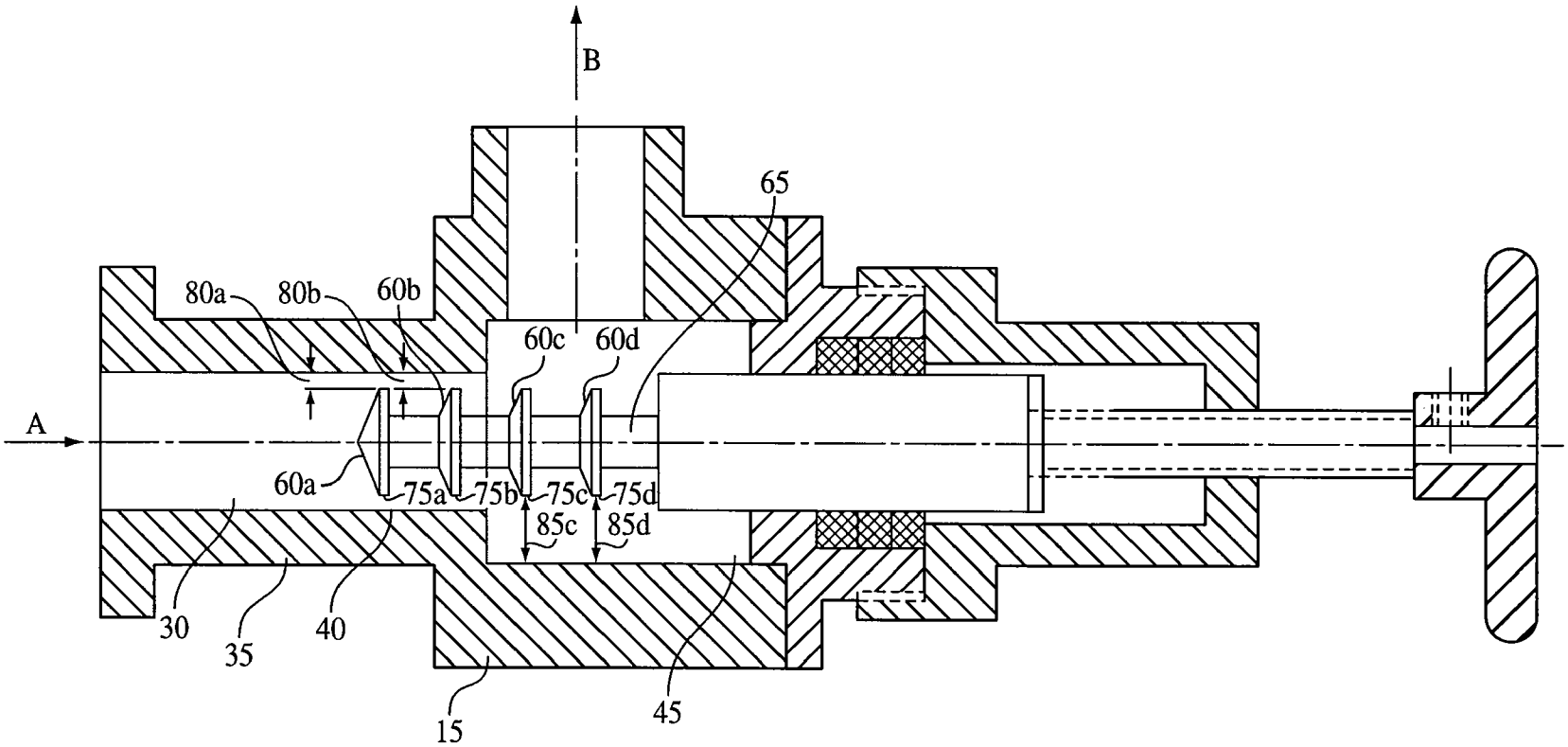
FIG. 3 illustrates the device 10 configured in a second state in order to subject the fluid to two stages of hydrodynamic cavitation.

Illustrated in FIG. 3 is one embodiment of the device 10 configured in a second state in order to subject the fluid to two stages of hydrodynamic cavitation. In this second state, the first and second baffles 60*a–b* are positioned in the upstream portion 30 of the flow-through chamber 15, while the remaining baffles (i.e., baffles 60*c–d*) are positioned in the downstream portion 45 of the flow-through chamber 15. When the first and second baffles 60*a–b* are positioned in the upstream portion 30 of the flow-through chamber 15, the first baffle 60*a* is configured to generate a first hydrodynamic cavitation field downstream from the first baffle 60*a* via the first local constriction 80*a* of fluid flow and the second baffle 60*b* is configured to generate a second hydrodynamic cavitation field downstream from the second baffle 60*b* via a second local constriction 80*b* of fluid flow. As discussed above, the size of the local constrictions 80*a–b* are sufficient enough to increase the velocity of the fluid flow to a minimum velocity necessary to achieve hydrodynamic cavitation for the fluid being processed.

In this second state, the fluid is subjected to two stages of hydrodynamic cavitation because the first and second baffles 60*a–b* are positioned in the upstream portion 30 of the flow-through chamber 15. The remaining baffles (i.e., third and fourth baffles 60*c–d*) are positioned in the downstream portion 45 of the flow-through chamber 15, which provides gaps 85*c–d* defined between the inner surface 55 of the downstream wall 50 and the cylindrically-shaped surfaces

75*c–d* of the baffles 60*c–d,* respectively. The size of the gaps 85*c–d* are sufficiently large enough so as to not materially affect the flow of the fluid. In other words, the gaps 85*c–d* are sufficiently large enough so that hydrodynamic cavitation is not generated downstream from each baffle positioned in the downstream portion 45 of the flow-through chamber 15.

Figure 4:
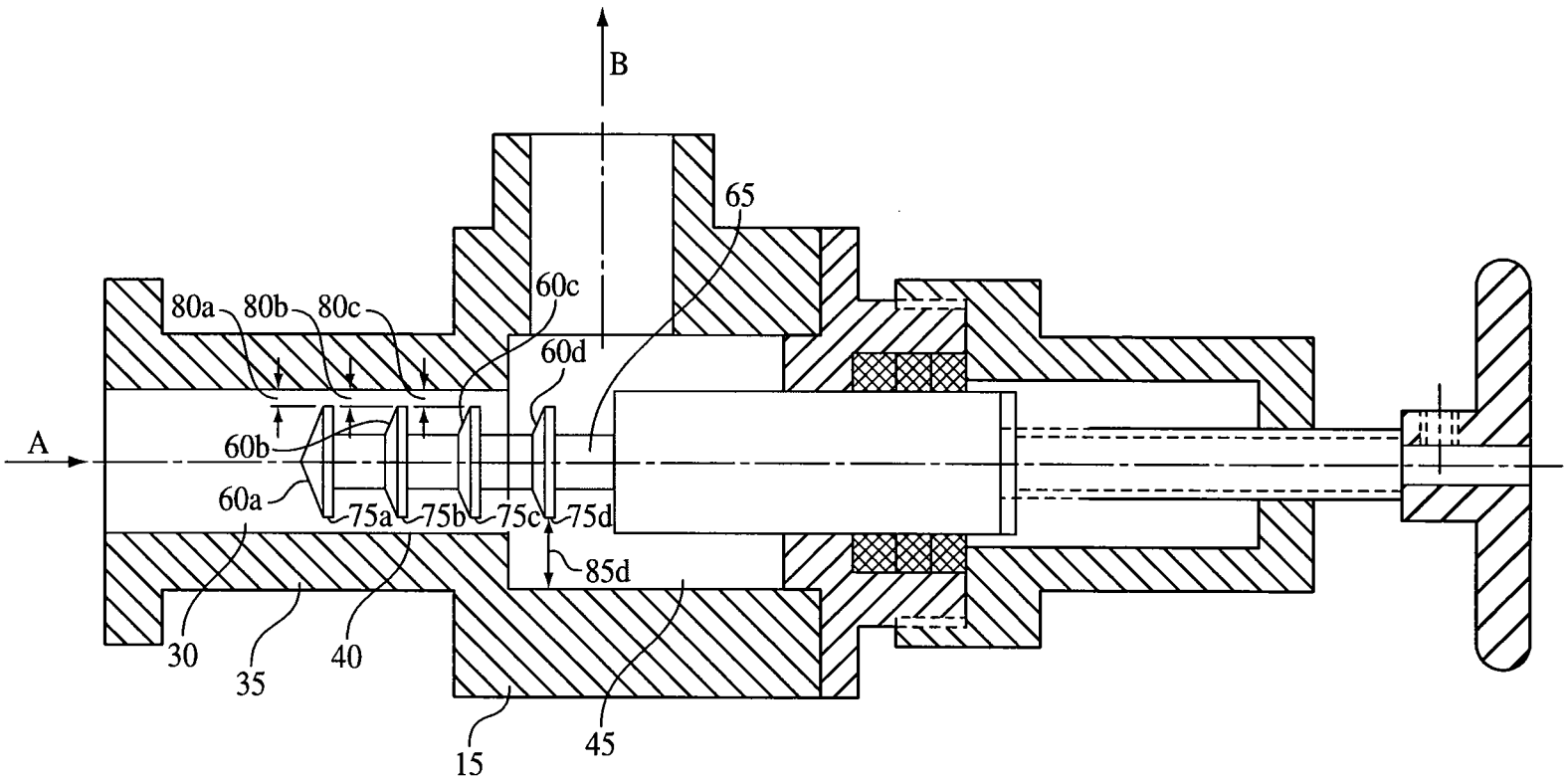
FIG. 4 illustrates the device 10 configured in a third state in order to subject the fluid to three stages of hydrodynamic cavitation.

Illustrated in FIG. 4 is one embodiment of the device 10 configured in a second state in order to subject the fluid to two stages of hydrodynamic cavitation. In this second state, the first, second, and third baffles 60*a–c* are positioned in the upstream portion 30 of the flow-through chamber 15, while the remaining baffle (i.e., baffle 60*d*) is positioned in the downstream portion 45 of the flow-through chamber 15. When the first, second, and third baffles 60*a–c* are positioned in the upstream portion 30 of the flow-through chamber 15, the first baffle 60*a* is configured to generate a first hydrodynamic cavitation field downstream from the first baffle 60*a* via the first local constriction 80*a* of fluid flow, the second baffle 60*b* is configured to generate a second hydrodynamic cavitation field downstream from the second baffle 60*b* via the second local constriction 80*b* of fluid flow, and the third baffle 60*c* is configured to generate a third hydrodynamic cavitation field downstream from the second baffle 60*c* via the second local constriction 80*c* of fluid flow.

In this third state, the fluid is subjected to three stages of hydrodynamic cavitation because the first, second, and third baffles 60*a–c* are positioned in the upstream portion 30 of the flow-through chamber 15. The remaining baffle (i.e., fourth baffle 60*d*) is positioned in the downstream portion 45 of the flow-through chamber 15, which provides the gap 85*d* defined between the inner surface 55 of the downstream wall 50 and the cylindrically-shaped surfaces 75*d* of the baffle 60*d*. The size of the gap 85*d* is sufficiently large enough so that hydrodynamic cavitation is not generated downstream from the fourth baffle 60*d* positioned in the downstream portion 45 of the flow-through chamber 15.

In the same manner, the fluid can be subjected to four stages of hydrodynamic cavitation by positioning all four baffles 60*a–d* in the upstream portion 30 of the flow-through chamber 15. It will be appreciated that since any number of baffles can be used to implement the device 10, a corresponding number of hydrodynamic cavitation stages can be generated by the device 10.

It will be appreciated that if the flow-through chamber 15 has a circular cross-section and the first baffle 60*a* has cylindrically-shaped portion 75*a,* then the local constriction 80*a* of fluid flow can be characterized as an annular orifice. It will also be appreciated that if the cross-section of the flow-through chamber 15 is any geometric shape other than circular, then the local constriction of flow may not be annular in shape. Likewise, if a baffle is not circular in cross-section, then the corresponding local constriction of flow may not be annular in shape.

To selectively move the one or more baffles 60*a–d* into the upstream portion of the flow-through chamber 15, the shaft 65 is slidably mounted in the device 10 to permit axial movement of the baffles 60*a–d* between the upstream portion 30 and the downstream portion 45 of the flow-through chamber 15. In one embodiment, the shaft 65 can be manually adjusted and locked into position by any locking means known in the art such as a threaded nut or collar (not shown). In an alternative embodiment, the shaft 65 can be coupled to an actuation mechanism (not shown), such as a motor, to adjust the axial position of the baffles 60*a–d* in the flow-through chamber 15. It will be appreciated that other suitable electromechanical actuation mechanisms can be used such as a belt driven linear actuator, linear slide, rack and pinion assembly, and linear servomotor. It will also be appreciated that other types of actuation mechanisms can be used such as slides that are powered hydraulically, pneumatically, or electromagnetically.

Figure 5:
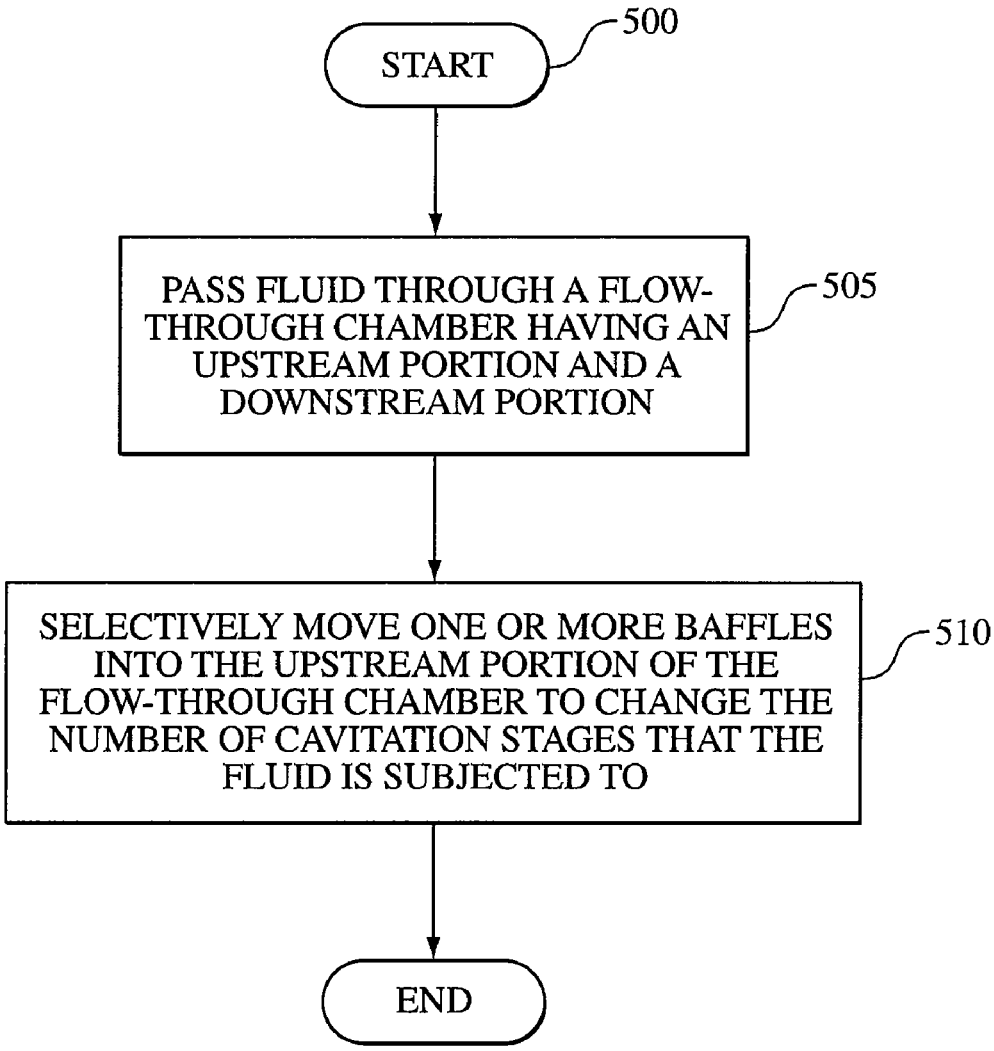
FIG. 5 illustrates one embodiment of a methodology for of generating one or more stages of hydrodynamic cavitation in a fluid.

Illustrated in FIG. 5 is one embodiment of a methodology associated with generating one or more stages of hydrodynamic cavitation in a fluid. The illustrated elements denote "processing blocks" and represent functions and/or actions taken for generating one or more stages of hydrodynamic cavitation. In one embodiment, the processing blocks may represent computer software instructions or groups of instructions that cause a computer or processor to perform an action(s) and/or to make decisions that control another device or machine to perform the processing. It will be appreciated that the methodology may involve dynamic and flexible processes such that the illustrated blocks can be performed in other sequences different than the one shown and/or blocks may be combined or, separated into multiple components. The foregoing applies to all methodologies described herein.

With reference to FIG. 5, the process 500 involves a hydrodynamic cavitation process. The process 500 includes passing fluid through a flow-through chamber having an upstream portion and a downstream portion (block 505). The downstream portion of the flow-through chamber can include one or more baffles disposed therein. To change the number of cavitation stages that the fluid is subjected to, one or more baffles can be selectively moved into the upstream portion of the flow-through chamber to generate a hydrodynamic cavitation field in the fluid downstream from each baffle moved into the upstream portion of the flow-through chamber (block 510). Accordingly, the number of baffles moved into the upstream portion of the flow-through chamber can correspond to the number of cavitation stages that the fluid is subjected to.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

What is claimed is:

1. A device for creating hydrodynamic cavitation in fluid, the device comprising:

a flow-through chamber having an upstream portion and a downstream portion, the upstream and downstream portions being substantially cylindrical in shape and having different diameters wherein the diameter of the upstream portion is less than the diameter of the downstream portion; and a plurality of baffles provided within the downstream portion of the flow-through chamber wherein the diameters of the baffles are substantially equal, wherein one or more of the plurality of baffles are configured to be selectively movable into the upstream portion of the flow-through chamber to generate a hydrodynamic cavitation field downstream from each baffle moved into the upstream portion of the flow-through chamber.

2. The device of claim 1 wherein the upstream portion is defined by a first inner surface and the downstream portion is defined by a second inner surface, wherein a first gap is defined between the first inner surface and the perimeter of one of the baffles and a second gap is defined between the second inner surface and the perimeter of one of the baffles, wherein the size of the first gap is sufficiently less than the size of the second gap such that hydrodynamic cavitation is generated as fluid passes through the first gap, while hydrodynamic cavitation is not generated as fluid passes through the second gap.

3. The device of claim 1 wherein the plurality of baffles are connected to a shaft in a fixed position relative to one another along the length of the shaft.

4. The device of claim 3 further comprising a mechanism to axially move the shaft within the flow-through chamber.

5. The device of claim 1 wherein the plurality of baffles are movable along the axial center of the flow-through chamber.

6. The device of claim 1 wherein at least one of the plurality of baffles is conically-shaped having a tapered portion that confronts fluid flow.

7. A device for dynamically generating multiple stages of hydrodynamic cavitation in fluid, the device comprising:

a housing having an inlet, an outlet, and internal chambers, the internal chambers including:

a first substantially cylindrical chamber having a first diameter, the first chamber in fluid communication with the inlet; and a second substantially cylindrical chamber having a second diameter that is, greater than the first diameter, the second chamber in fluid communication with the first chamber and with the outlet; and a plurality of baffles contained in the housing and connected in a fixed position relative to one another along the length of a shaft, the baffles having substantially the same diameter, the baffles configured to be movable between the first and second chambers by positioning of the shaft to provide for one or more hydrodynamic cavitation stages in the fluid when a corresponding number of baffles are located in the first chamber.

8. A method of generating one or more stages of hydrodynamic cavitation in a fluid, the flow-through chamber having a substantially cylindrical upstream portion, a substantially cylindrical downstream portion, and a plurality of baffles having substantially equal diameters, the baffles being contained in the downstream portion of the flow-through chamber, the method comprising:

passing fluid through the flow-through chamber; and selectively moving one or more baffles into the upstream portion of the flow-through chamber to generate a hydrodynamic cavitation field in the fluid downstream from each baffle moved into the upstream portion of the flow-through chamber.

9. The method of claim 8 wherein each baffle moved into the upstream portion of the flow-through chamber defines a cavitation stage such that multiple cavitation stages are generated when multiple baffles are moved into the upstream portion of the flow-through chamber.

10. The device of claim 7 wherein the first chamber is defined by a first inner surface and the second chamber is defined by a second inner surface, wherein a first gap is defined between the first inner surface and the perimeter of one of the baffles and a second gap is defined between the second inner surface and the perimeter of one of the baffles, wherein the size of the first gap is sufficiently less than the size of the second gap such that hydrodynamic cavitation is generated as fluid passes through the first gap, while hydrodynamic cavitation is not generated as fluid passes through the second gap.

11. The device of claim 7 further comprising a mechanism to axially move the shaft within the housing.

12. The device of claim 7 wherein the plurality of baffles are movable along the axial center of the flow-through chamber.

13. The device of claim 7 wherein at least one of the plurality of baffles is conically-shaped having a tapered portion that confronts fluid flow.

14. A device for dynamically generating multiple stages of hydrodynamic cavitation in fluid, the device comprising:

a housing having an inlet, an outlet, and internal chambers, the internal chambers including:

a first chamber having a first cross-sectional area, the first chamber in fluid communication with the inlet; and a second chamber having a second cross-sectional area that is greater than the first cross-sectional area, the second chamber in fluid communication with the first chamber and with the outlet; and a plurality of baffles contained in the housing and connected in a fixed position relative to one another along the length of a shaft, the baffles having substantially the same diameter, the baffles configured to be movable between the first and second chambers by positioning of the shaft to provide for one or more hydrodynamic cavitation stages in the fluid when a corresponding number of baffles are located in the first chamber, wherein the first chamber is defined by a first inner surface and the second chamber is defined by a second inner surface, wherein a gap is defined between the first inner surface and the perimeter of one of the baffles, wherein the size of the gap for one baffle located in the first chamber is substantially the same as the size of the gap for other baffles located in the first chamber.

15. The device of claim 14 wherein a gap is defined between the second inner surface and the perimeter of one of the baffles, wherein the size of the gap for one baffle located in the second chamber is substantially the same as the size of the gap for other baffles located in the second chamber.

16. The device of claim 14 further comprising a mechanism to axially move the shaft within the housing.

17. The device of claim 14 wherein the plurality of baffles are movable along the axial center of the flow-through chamber.

18. The device of claim 14 wherein at least one of the plurality of baffles is conically-shaped having a tapered portion that confronts fluid flow.

* * * * *